United States Patent [19]

Pritchard

[11] Patent Number: 4,924,793

[45] Date of Patent: May 15, 1990

[54] STANDOFF BATTEN RIG FOR FLEXIBLE AIRFOIL CONFORMATION ON BOTH TACKS

[76] Inventor: James S. Pritchard, P.O. Box N-885, Nassau, The Bahamas

[21] Appl. No.: 342,555

[22] Filed: Apr. 24, 1989

[51] Int. Cl.[5] ..... B63H 9/10

[52] U.S. Cl. ..... 114/102; 114/39.2; 114/89

[58] Field of Search ..... 114/39.1, 39.2, 102, 114/103, 104, 109, 111, 89

[56] References Cited

U.S. PATENT DOCUMENTS

| | | | |
|---|---|---|---|
| 4,487,146 | 12/1984 | Parmentier | 114/102 |
| 4,625,671 | 12/1986 | Nishimuira | 114/103 |
| 4,649,848 | 3/1987 | Belvedere | 114/102 |

FOREIGN PATENT DOCUMENTS

| | | | |
|---|---|---|---|
| 1905317 | 8/1970 | Fed. Rep. of Germany | 114/102 |
| 2576578 | 8/1986 | France | 114/102 |

*Primary Examiner*—Joseph F. Peters, Jr.
*Assistant Examiner*—Edwin L. Swinehart

[57] ABSTRACT

A rig battened with standoff battens presents a concave camber towards the wind on both tacks while remaining on one side of the mast as each batten comprises a member of a rigid leading portion connected to a flexible portion continuous to a semi rigid trailing portion. A holder attaches to the leading portion and the trailing portion to hold off the batten with presprung bow like arms. A ring part of the holder fixed on the opposite side from the arms attaches the batten assembly to the mast. Lines lead from the winch to the points at which the holder attaches to the batten such that on winching the arms are drawn back and the rig flattens out. Additionally the connection between the lead and the flexible center can be pined and the connection between the holder and the rigid leading part can be pined to an adjustable bracket part of the leading portion to enable it the leading portion to move out of curve with the batten to amplify the camber of the rig.

2 Claims, 2 Drawing Sheets

STANDOFF BATTEN RIG FOR FLEXIBLE AIRFOIL CONFORMATION ON BOTH TACKS

This invention relates to a improvement in the junk rig sail plan which is fully battened and is the closest relation to the standoff batten rig which is also fully battened but unlike the junk rig the standoff batten rig can camber to present a concave shape to the wind on both tacks while the rig remains on the same side of the mast.

BACKGROUND OF THE INVENTION, FIELD AND PRIOR ART

Development of sailing rigs has concentrated on automation of rigs such as the square rig aboard freighters and furling rigs aboard passenger liners. Other developments include many details related to sail handling and setting. In the field of windsurfing there are many detailed development such as Mr. T. G. Nishimura in his sailing system U.S. Pat. No. 4,625,671 and Mr. M. S. Belevedere in his flexible wing rib sail U.S. Pat. No. 4,649.848. As the use of fully battened mainsails has increased so to have the details of batten construction as shown by Mr. J. A. Parmentier in U.S. Pat. No. 4,487,146 and Y. Parlier in Fr Pat 2,576,578-A1. An example of a commercial adaption of the square rig is shown by W. Noldechen in DT Pat 1,905,317. Other commercial development involves computerized analysis and setting of sail relative to wind conditions.

SUMMARY OF THE INVENTION

The power of the sail and existing concave cambering toward the wind can be increased by the inflection of the leading part of the batten which amplifies the camber on each respective tack. The rig can tack without the difficulties encountered by a traditional square rig. Similar camber is presented to the wind on each tack. On one tack wind pressure enfroces the camber and on the opposite tack the camber is enforced by the preconfiguration of the holder which is presprung to a maximum determined for the rig in advance. From the position of maximum camber the batten is then flattened out to suit wind conditions. The batten adapts to different sail plans such as a junk rig or offset square rig and creates a new rig which imitates a fixed solid surfaced wing with leading edge flaps.

Construction can involve metal sections, laid up resin reinforced glass fibres, mechanical joints, and pins.

Design of a standoff batten rig for a particular sail plan or use will involve attention to the construction of uniform section masts for unstayed use and mast top details for stayed masts. Since the battens function as lightweight booms sheets can attach to more than one batten serially or in parallel.

Reefing points will be from batten to batten.

The batten will adapt to some curvature for use in the head or foot of the rig. Construction of the rig need not be weighty.

BRIEF DESCRIPTION OF THE DRAWINGS

The following specification illustrates a specific embodiment described with reference to the drawings in which.

DESCRIPTION OF THE PREFERRED EMBODIMENT

Figure 1:
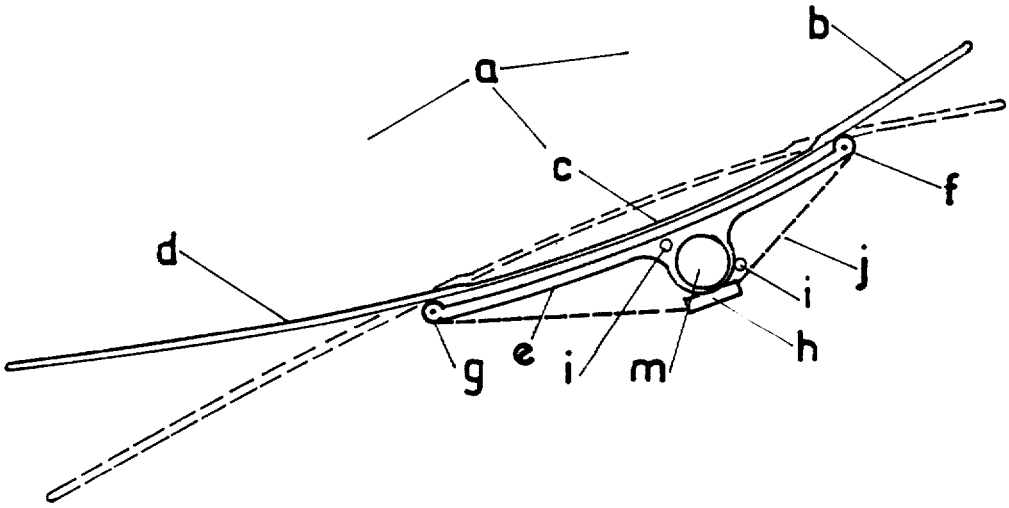
FIG. 1 shows a plan of the standoff batten assembly with the stood off tack position shown as a dashed line.
Figure 2:
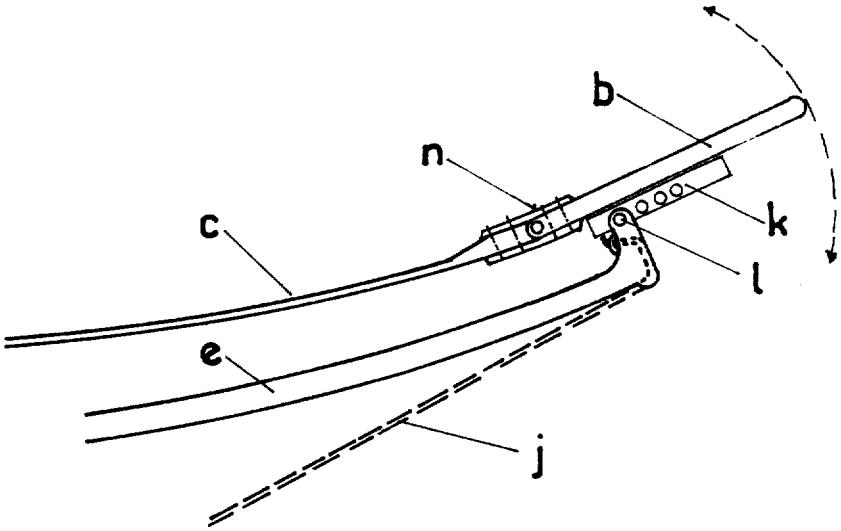
FIG. 2 shows the leading edge articular assembly.

In accordance with this invention refer to FIG. 1 and the batten part -a- which comprises the rigid lead -b-, a flexible yet stiff center -c- and a semi rigid trailing -d-. The batten -a- is a one piece construction with section variations of size and or section properties due to proportions determining the required stiffness. The batten attaches at two points to a holder -e- which is presprung like a bow laid on its side but made for reverse bending. The amount of camber in the holder and its stiffness are preselected. The holder attaches to the batten at two positions -f- and -g-, one near the inward end of the rigid leading part and one near the inward end of the trailing portion. These connections can be bolted or pined. In some rigs the connections at -f- and -g- can be made by molding the batten and holder as one structural piece. At the batten connection to the holder -f- and -g- lines -j- lead to a winch type mechanism -h- which controls the camber of the holder by drawing back the arms. The winch -h- is fixed to the opposite side of the ring -m- from the holder. In this instance all the rings are similarly sized and the mast would be a uniform section. The winches mounted on the rings can be line driven either separately or together after tuning. To flex properly each batten assembly must be kept square by the two halyard lines -i- running through each batten. Additionally the standoff batten rig can incorporate a leading part articulator as illustrated in FIG. 2 in which the lead part -b- and the flexible center -c- are connected by a pined connection to allow each part to move freely. Expected sudden motion due to tacking and wind gusts requires rubber or similar shock absorbers -n- on each side and or around the pined connection. On the holder side of the leading part is fixed a adjustable bracket -k- to which the forward arm of the holder is pined at -l-. In order to provide room for inflection of the leading part the end of the forward arm of the holder can be wristed or dog legged. The position of the forward arm in the adjustable bracket will determine the degree of inflection of the leading part on both tacks.

Figure 3:
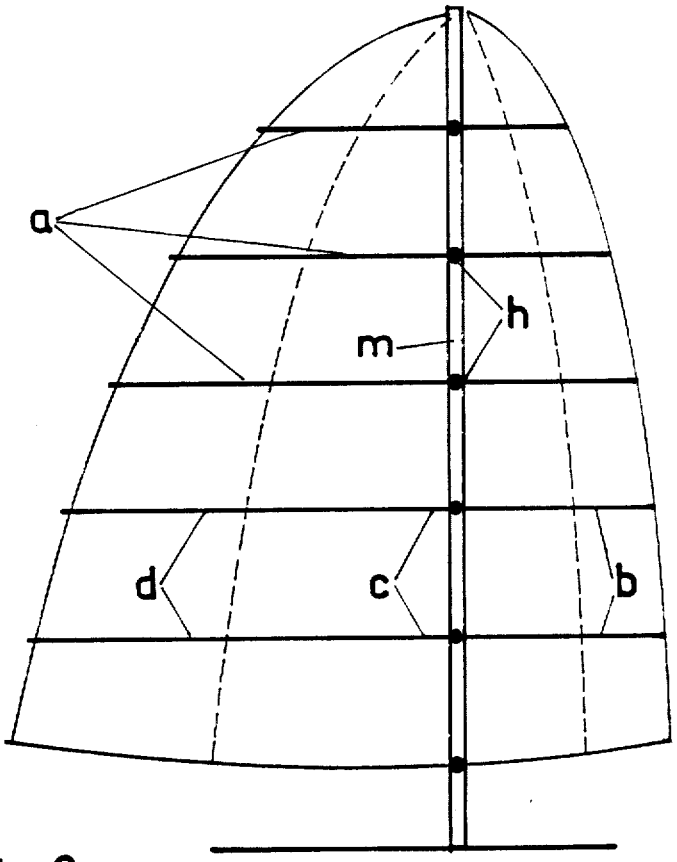
FIG. 3 shows a diagram of an airfoil shaped sailplan.

FIG. 3 shows a typical airfoil type sailpin with standoff batten assemblies -a- set along the vertical axis of the sail. The leading inflecting part is -b-, the center bending part -c- and the trailing part -d-. The rig can be positioned as shown on the mast -m-.

Figure 4:
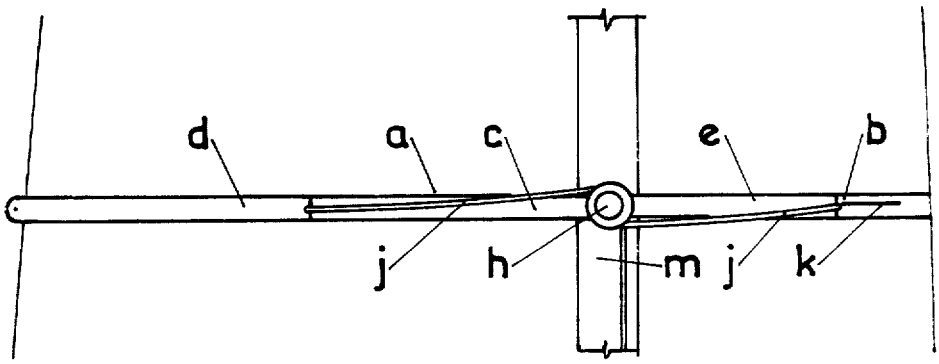
FIG. 4 shows an elevation of a batten assembly.

FIG. 4 shows an elevation of the batten assembly of parts -a-, -b-, -c- and -d- of the batten and the holder parts -e-, -j- and -h- and the artciclator bracket -k- all in one plane along side the mast -m-. The batten can connect to the sails in a traditional manner using batten pockets with cut outs for the connections to the holder. Or, if the batten and holder are made as one piece the sail can be laced on.

I claim:

1. A standoff batten rig for providing a cambered configuration to a sail supported by a mast comprising a three part batten having a first rigid leading part continuous to a second flexible center part which is continuous to a third semi-rigid tailing part, a holder which has near its center a ring which is slidably supported by the mast and two pre-sprung arms which are attached respectively to the leading part and trailing part of the batten by bolts or pins, the holder further has a control line which extends from the ends of the arms to a winch means which is fixed to the holder side opposite the batten, such that upon application of tension in the control line by the winch means causes the presprung arms to flex thereby causing a change in the amount of camber of the sail.

2. A standoff batten rig as defined in claim 1, and further comprising a tendoned or pined, shock absorbing connection between the first leading part and second flexible part of the batten, the first leading part of the batten on a side thereof adjacent the holder having an adjustable bracket which is attached by bolts or pins to a respective presprung arm of the holder, whereby application of tension in the control line by the winch means causes the first leading part to articulate with respect to the second flexible part, and the adjustable bracket allows the magnitude of articulation to be adjusted.

* * * * *